US007347018B2

(12) United States Patent
Haggard, Jr.

(10) Patent No.: US 7,347,018 B2
(45) Date of Patent: Mar. 25, 2008

(54) BANNER DISPLAY SYSTEM

(76) Inventor: William Luther Haggard, Jr., 13525 Inverness Pl., Athens, AL (US) 35611-6991

( * ) Notice: Subject to any disclaimer, the term of this patent is extended or adjusted under 35 U.S.C. 154(b) by 116 days.

(21) Appl. No.: 11/277,542

(22) Filed: Mar. 27, 2006

(65) Prior Publication Data

US 2006/0156601 A1 Jul. 20, 2006

Related U.S. Application Data

(63) Continuation-in-part of application No. 11/119,153, filed on Apr. 29, 2005, now Pat. No. 7,213,356, which is a continuation-in-part of application No. 10/930,330, filed on Aug. 31, 2004, now Pat. No. 7,069,679, which is a continuation-in-part of application No. 10/616,616, filed on Jul. 10, 2003, now Pat. No. 6,892,486, which is a continuation of application No. 09/881,496, filed on Jun. 14, 2001, now abandoned.

(51) Int. Cl.
*G09F 17/00* (2006.01)

(52) U.S. Cl. ..... 40/604; 40/592; 40/597; 40/606.01; 248/206.3

(58) Field of Classification Search ..... 40/592, 40/597, 603, 604, 606.01, 602; 248/206.3, 248/206.4
See application file for complete search history.

(56) References Cited

U.S. PATENT DOCUMENTS

| | | | | |
|---|---|---|---|---|
| 1,406,916 A | | 2/1922 | Arnold | |
| 1,598,438 A | * | 8/1926 | Hallowell | 40/606.01 |
| 2,243,912 A | | 6/1941 | Legler | |
| 2,515,313 A | * | 7/1950 | Pember, Sr. | 40/606.13 |
| 2,865,124 A | | 12/1958 | Mortellito | |
| 2,888,763 A | * | 6/1959 | Roycroft, Jr. | 40/592 |
| 3,148,856 A | | 9/1964 | Orlando | |
| 3,208,173 A | * | 9/1965 | Shank | 40/592 |
| 3,494,405 A | * | 2/1970 | Bartelmas et al. | 160/24 |
| 3,633,299 A | | 1/1972 | Westlin | |
| 3,698,114 A | | 10/1972 | Hirsch et al. | |
| 3,818,599 A | | 6/1974 | Tague | |
| 3,922,998 A | * | 12/1975 | May | 116/40 |
| 3,924,344 A | * | 12/1975 | Davis | 40/592 |
| 3,955,786 A | | 5/1976 | Duddy | |
| 3,966,231 A | | 6/1976 | Metzler | |
| 4,012,056 A | | 3/1977 | Christensen | |
| 4,084,338 A | * | 4/1978 | Ross | 40/592 |
| 4,169,610 A | | 10/1979 | Paufler | |
| 4,241,530 A | | 12/1980 | Hartvig | |
| 4,365,435 A | * | 12/1982 | Snyder, Jr. | 40/608 |
| 4,574,726 A | | 3/1986 | Sullivan | |
| 4,666,176 A | | 5/1987 | Sand | |
| 4,667,428 A | | 5/1987 | Elmer | |
| 4,700,655 A | | 10/1987 | Kirby | |
| 4,723,788 A | | 2/1988 | Suter | |

(Continued)

*Primary Examiner*—Gary C. Hoge
(74) *Attorney, Agent, or Firm*—Luedeka, Neely & Graham, PC

(57) ABSTRACT

A display system for displaying a banner, the system including a banner made of flexible, non-rigid sheet material, a frame system to support the banner, and a mounting system connectable to the frame and including a body defining a passageway configured for slidably receiving a portion of the frame and a pair of extensions each extending away from the passageway and defining a receiver for receiving an attachment member.

4 Claims, 3 Drawing Sheets

U.S. PATENT DOCUMENTS 4,866,866 A 9/1989 Rotter et al.
4,878,303 A * 11/1989 Banniza et al. ..... 40/606.14
4,937,962 A 7/1990 Hornblad
5,048,451 A * 9/1991 Reimers et al. ..... 40/602
5,113,588 A 5/1992 Walston
5,172,505 A 12/1992 Borsella
5,181,284 A 1/1993 Raphael et al.
5,269,554 A 12/1993 Law et al.
5,502,909 A * 4/1996 Rabkin ..... 40/603
5,558,352 A 9/1996 Mills
D378,669 S 4/1997 Gregory
5,737,862 A 4/1998 Cooper et al.
6,553,929 B1 * 4/2003 Harp ..... 116/173
6,618,973 B2 9/2003 Nelson
6,892,486 B2 5/2005 Haggard, Jr.
2001/0003878 A1 * 6/2001 Dawkins ..... 40/603

* cited by examiner

BANNER DISPLAY SYSTEM

CROSS REFERENCE TO RELATED APPLICATIONS

This application is a continuation-in-part of application Ser. No. 11/119,153 filed Apr. 29, 2005 now U.S. Pat. No. 7,213,356, and entitled BANNER DISPLAY SYSTEM, which is a continuation-in-part of application Ser. No. 10/930,330 filed Aug. 31, 2004 now U.S. Pat. No. 7,069, 679, and entitled BANNER DISPLAY SYSTEM, which is a continuation-in-part of application Ser. No. 10/616,616 filed Jul. 10, 2003, and entitled BANNER DISPLAY SYSTEM (U.S. Pat. No. 6,892,486, issued May 17, 2005), which is a continuation of application Ser. No. 09/881,496 filed Jun. 14, 2001, and entitled BANNER DISPLAY SYSTEM, now abandoned.

FIELD OF THE INVENTION

The present invention relates to displays. More particularly, the invention relates to systems for displaying banners, signage and the like.

BACKGROUND AND SUMMARY OF THE INVENTION

Various devices for displaying signs and banners are known in the art. However, such devices desire improvement in that they are typically not suitable for use to display a banner or the like on a moving vehicle. Accordingly, there is a need in the art for an improved system for displaying signs and banners and, particularly signs and banners made of non-rigid sheet materials.

The present invention relates to a display system for displaying a banner. In a preferred embodiment, the display system includes a banner made of flexible, non-rigid sheet material, a frame system to support the banner, and a mounting system connectable to the frame. The mounting system includes a body defining a passageway configured for slidably receiving a portion of the frame and a pair of extensions each extending away from the passageway and defining a receiver for receiving an attachment member.

The mounting system may be used alone, or in combination with a primary mounting system associated with the frame.

BRIEF DESCRIPTION OF THE DRAWINGS

Further aspects of the invention will become apparent by reference to the detailed description of preferred embodiments when considered in conjunction with the figures, which are not to scale, wherein like reference number, indicate like elements through several views.

DETAILED DESCRIPTION

Figure 1:
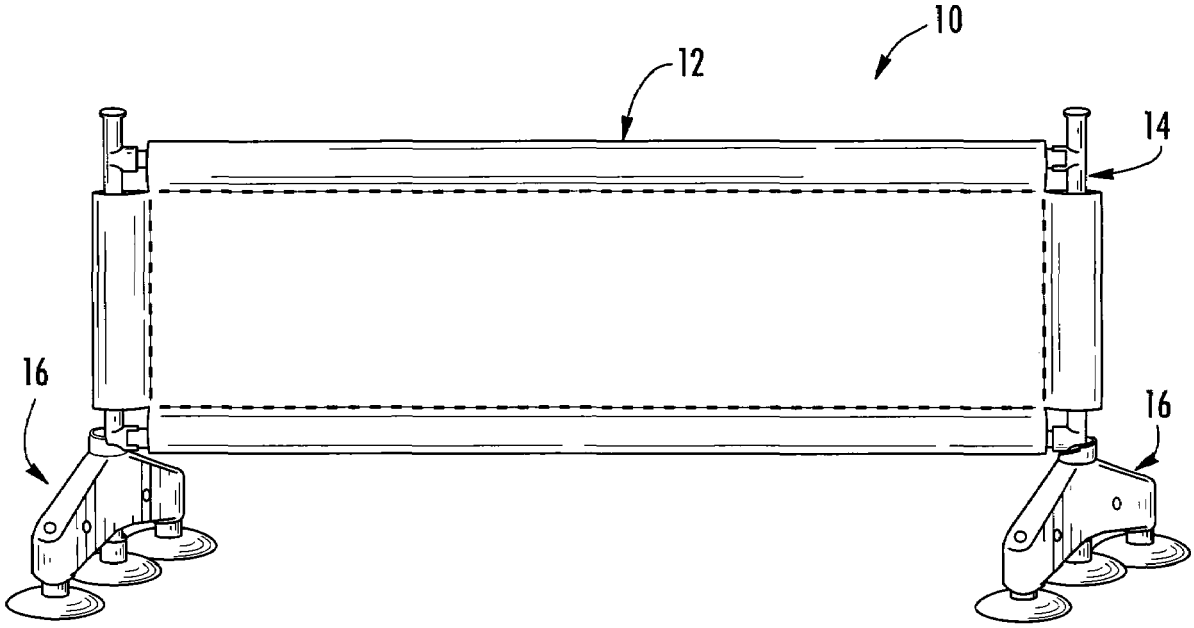
FIG. 1 is a perspective view of a display system according to a preferred embodiment.
Figure 2:
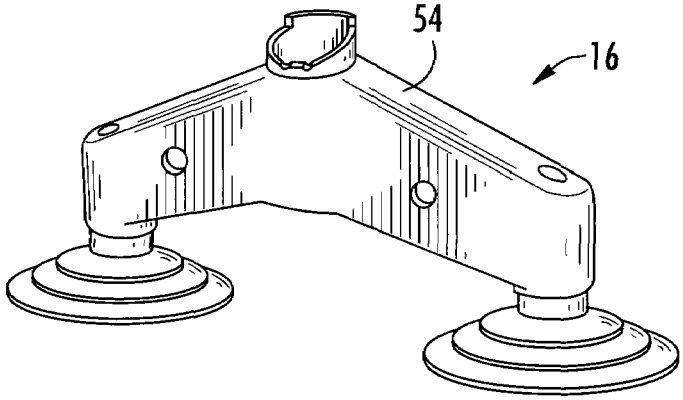
FIG. 2 is a perspective view of an auxiliary mounting member of the display system of FIG. 1.
Figure 3:
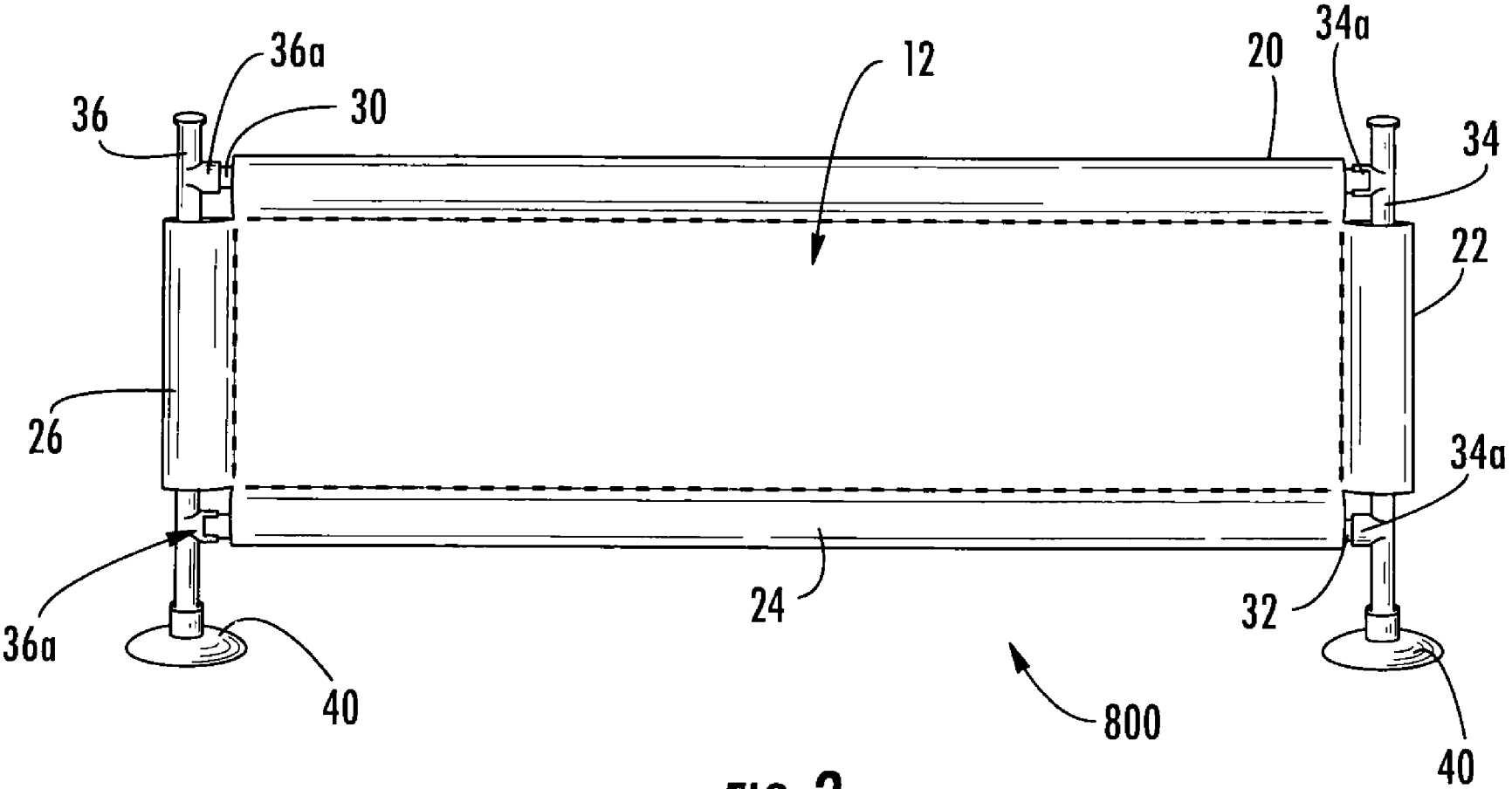
FIG. 3 is a side view of banner and a frame of the display system of FIG. 1.
Figure 4:
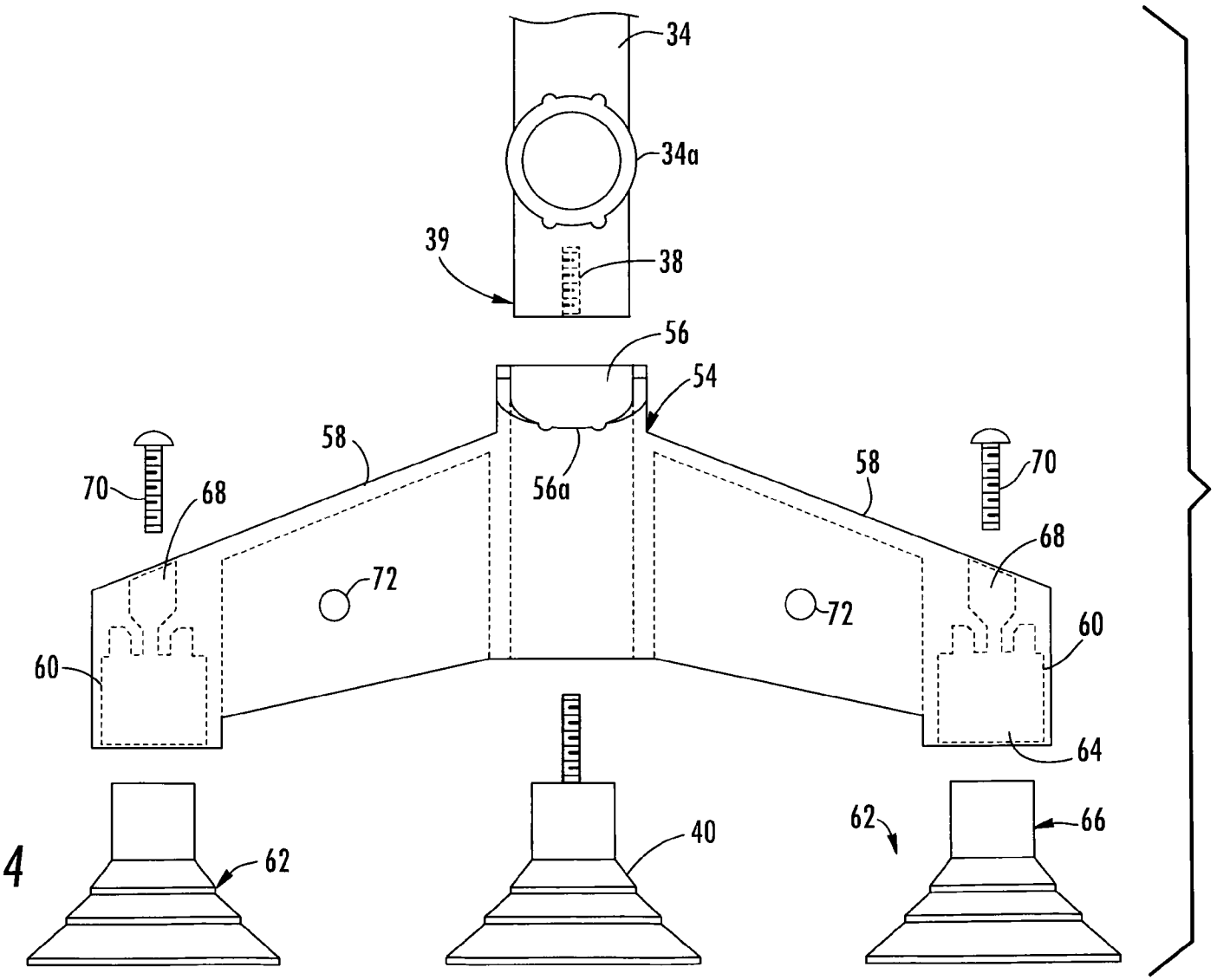
FIG. 4 is a side view of the auxiliary mounting member of FIG. 2, further showing installation of the frame thereto.

With reference to the drawings, there is shown a display system 10 that is particularly suitable for displaying signs and banners on surfaces, such as on car and truck roofs as well as other forms of transportation while traveling. The display system 10 preferably includes a banner 12, a frame system 14 to support the banner member 12, and an auxiliary mounting system 16 for mounting the display system onto a surface, such as the roof of an automobile.

The banner 12 may be made of a flexible, non-rigid sheet material, and includes a plurality of elongate sleeves 20, 22, 24, and 26. The sheet material is preferably provided as a one-piece blank including a front surface and an opposite back surface, preferably having indicia or a logo located on one or both of the surfaces. The indicia or logo is preferably applied to the banner 12 as by screen printing or the like.

The frame system 14 for supporting the banner 12 preferably includes a pair of horizontal frame members 30 and 32 and a pair of vertical frame members 34 and 36. The frame members are each slidably positionable within one of the sleeves of the banner, with each frame member having a length greater than the length of the sleeve into which it is positionable.

The vertical frame members 34 and 36 include a pair of spaced apart receivers 34*a* and 36*a*, respectively, for receiving ends of the horizontal frame members. Thread structure 38 is provided adjacent a lower end 39 of each of the vertical frame members for mounting of an attachment member to the end of the frame members. In a preferred embodiment, the attachment member is provided as by a suction cup 40. However, it will be understood that the attachment member may be other structure configured for engaging the automobile roof or other surface to which the display is to be mounted, such as a magnet or the like. The thread structure 38 may be an internal threaded bore for receiving a threaded shaft extending from an upper portion of the suction cup 40, or an external threaded shaft for being received by a threaded bore defined within an upper portion of the suction cup 40.

The banner and frame assembly are assembled by positioning each of the frame members within one of the sleeves of the banner and thereafter positioning the opposite ends of each horizontal frame member within one of the receivers of the vertical frame members. The suction cups 40 may be utilized to mount the thus assembled banner and frame assembly to a surface, such as the roof of an automobile. However, it has been observed that an improved mounting may be achieved by utilizing the banner and frame assembly in conjunction with auxiliary mounting system 16. It will also be understood that the auxiliary mounting system may be used as the only mounting system.

The auxiliary mounting system 16 preferably includes a mounting member 50, preferably of one-piece molded plastic construction, and a pair of suction cups 52 attachable to the mounting member 50.

The mounting member 50 includes a body 54 defining a passageway 56 configured to slidingly receive the lower end 39 of one of the vertical frame members 34 and 36. The passageway 56 is preferably substantially cylindrical and centrally located on the body 54. Upper end 56*a* of the passageway 56 is configured to matingly engage the receivers 34*a* and 36*a* so as to snugly seat the receivers therein. The body 54 further includes a pair of extensions 58 which extend, preferably oppositely, from the passageway 56. The extensions 58 preferably extend at an angle of from about 35 to about 55 degrees relative to the length axis of the passageway 56.

A receiver 60 is located on each of the extensions for receiving an auxiliary attachment member. In a preferred embodiment, each auxiliary attachment member is provided as by a suction cup 62. However, it will be understood that the auxiliary attachment member may be other structure configured for engaging the automobile roof or other surface to which the display is to be mounted, such as a magnet or the like. The receivers 60 preferably have a lower cylindrical end 64 configured for receiving a solid head portion 66 of the suction cups 60. An upper end 68 of each receiver 60 is configured for receiving a fastener 70, such as a screw or the like, for threadably engaging the head portion 66 of the cups 60 to secure the cups 60 in the receivers 60.

It has been observed that a whistling or other wind noise may occur during use of the mounting members 50 as part of the display 10. It has been discovered that configuring the extensions 58 to include one or more apertures 72 therethrough is helpful to reduce or eliminate such wind noise. The aperture 72 for the depicted configuration preferably has a diameter of about ⅜ inch.

To install the auxiliary mounting members 50 on the vertical frame members 34 and 36, the suction cups 40 are unthreaded from the lower ends 39 of the vertical members and the lower ends 39 passed through the passageways 56 until the receivers 34*a* and 36*a* are seated in upper ends 56*a* of the passageways. The suction cups 40 may then be re-installed on the ends of the vertical members 34 and 36. The thus assembled display may then be secured to a surface, such as the roof of an automobile, by pressing the attachment members, such as the suction cups 40 and 62, into engagement with the surface. To remove the display 10 from the surface, the vertical members 34 and 36 may be grasped and pulled upwardly to overcome the suction of the cups 40. The auxiliary mounting members 50 may then likewise be grasped and pulled to overcome the suction of the cups 62.

The foregoing description of certain exemplary embodiments of the present invention has been provided for purposes of illustration only. It is understood that numerous modifications or alterations may be made in and to the illustrated embodiments without departing from the spirit and scope of the invention as defined in the following claims.

What is claimed is:

1. A display system for displaying a banner, the system comprising:

a banner made of flexible, non-rigid sheet material, and including a plurality of elongated sleeves;

a frame system to support the banner, the frame system including a pair of horizontal frame members and a pair of vertical frame members, each slidably positionable within one of the sleeves, the vertical frame members each including a pair of spaced apart upper and lower receivers thereon for receiving ends of the horizontal frame members, wherein the banner and frame assembly are assembled by positioning each of the frame members within one of the sleeves and thereafter positioning the opposite ends of each horizontal frame member within one of the apertures of the vertical frame members;

a primary mounting system comprising a pair of first attachment members securable to lowermost ends of the vertical frame members; and an auxiliary mounting system comprising a pair of auxiliary mounting members, each of the auxiliary mounting members including a body defining a passageway configured for slidably receiving the lowermost end of one of the vertical frame members so that the lowermost end of the vertical frame member may be passed therethrough and one of the first attachment members secured therethrough, with an upper end of the passageway being configured to snugly seat one of the lower receivers therein, and a pair of extensions each extending away from the passageway and defining a receiver for receiving an auxiliary attachment member.

2. The display system of claim 1, wherein the first and the auxiliary attachment members comprise suction cups.

3. The display system of claim 1, wherein the extensions extend oppositely from the passageway.

4. The display system of claim 1, wherein the extensions each include an aperture defined therethrough to place the opposite sides of the extension in flow communication for reducing wind noise during use of the display system.

* * * * *